US011181009B2

(12) United States Patent
Hallouin et al.

(10) Patent No.: US 11,181,009 B2
(45) Date of Patent: Nov. 23, 2021

(54) ASSEMBLY FOR A TURBOMACHINE

(71) Applicant: Safran Helicopter Engines, Bordes (FR)

(72) Inventors: Baptiste Hallouin, Moissy-Cramayel (FR); Alexandre Montpellaz, Moissy-Cramayel (FR); Sylvain Pierre Votie, Moissy-Cramayel (FR); Fabrice Iparaguirre, Moissy-Cramayel (FR); Yann Danis, Moissy-Cramayel (FR)

(73) Assignee: Safran Helicopter Engines, Bordes (FR)

( * ) Notice: Subject to any disclaimer, the term of this patent is extended or adjusted under 35 U.S.C. 154(b) by 0 days.

(21) Appl. No.: 16/976,156

(22) PCT Filed: Feb. 28, 2019

(86) PCT No.: PCT/FR2019/050462
§ 371 (c)(1),
(2) Date: Aug. 27, 2020

(87) PCT Pub. No.: WO2019/166742
PCT Pub. Date: Sep. 6, 2019

(65) Prior Publication Data

US 2020/0408109 A1 Dec. 31, 2020

(30) Foreign Application Priority Data

Feb. 28, 2018 (FR) ..... 1851776

(51) Int. Cl.
*F01D 9/04* (2006.01)
*F01D 9/06* (2006.01)
(Continued)

(52) U.S. Cl.
CPC ..... *F01D 25/164* (2013.01); *F01D 9/041* (2013.01); *F01D 9/065* (2013.01); *F01D 25/18* (2013.01);
(Continued)

(58) Field of Classification Search
CPC ..... F01D 9/041; F01D 9/065; F01D 25/164; F01D 25/18; F01D 25/24; F05D 2220/323; F05D 2230/60; F05D 2240/24
See application file for complete search history.

(56) References Cited

U.S. PATENT DOCUMENTS 5,451,116 A * 9/1995 Czachor ..... F01D 9/065 403/338
6,109,022 A * 8/2000 Allen ..... F01D 5/025 60/223
(Continued)

FOREIGN PATENT DOCUMENTS

FR 2 708 681 A1 2/1995

*Primary Examiner* — Igor Kershteyn
(74) *Attorney, Agent, or Firm* — Blank Rome LLP

(57) ABSTRACT

An assembly for a turbomachine including an annular channel designed to form a flow duct for a flow of gas between two turbine stages of the turbomachine. The channel is bounded by a radially inner annular wall and a radially outer annular wall. The walls are connected by hollow arms that extend radially, a support having a radially outer annular part that is located radially outside the outer annular wall of the annular channel, and a radially inner annular part that is located radially inside the inner annular wall of the annular channel. The outer and inner parts of the support are connected by connecting parts that extend radially and pass through one of the hollow arms of the annular channel. The connecting parts may be connected by a connecting partition having a frangible part that ruptures when the mechanical stresses in the connecting partition are above a threshold.

16 Claims, 3 Drawing Sheets

(51) Int. Cl.
*F01D 25/16* (2006.01)
*F01D 25/18* (2006.01)
*F01D 25/24* (2006.01)

(52) U.S. Cl.
CPC ..... *F01D 25/24* (2013.01); *F05D 2220/323* (2013.01); *F05D 2230/60* (2013.01); *F05D 2240/24* (2013.01)

(56) References Cited

U.S. PATENT DOCUMENTS

| | | | | |
|---|---|---|---|---|
| 6,240,719 | B1 * | 6/2001 | Vondrell | F01D 21/04 60/223 |
| 6,402,469 | B1 * | 6/2002 | Kastl | F01D 21/045 416/2 |
| 6,494,032 | B2 * | 12/2002 | Udall | F01D 21/045 415/9 |
| 8,099,962 | B2 | 1/2012 | Durocher et al. | |
| 8,430,622 | B2 * | 4/2013 | Webster | F01D 21/08 415/9 |
| 9,777,596 | B2 * | 10/2017 | Raykowski | F01D 25/162 |
| 2012/0227371 | A1 | 9/2012 | Johnson et al. | |

* cited by examiner

ASSEMBLY FOR A TURBOMACHINE

CROSS REFERENCE TO RELATED APPLICATIONS

This application is a national phase of PCT/FR2019/050462, filed Feb. 28, 2019, which claims the benefit of French Application No. 1851776, filed Feb. 28, 2018, the subject matter of each of which are incorporated by reference herein in their entirety.

FIELD OF THE INVENTION

The present invention relates to an assembly for a turbomachine, such as, for instance, an aircraft turbojet engine or a turboprop engine.

BACKGROUND OF THE INVENTION

FIG. 1 shows a part of a turbomachine 1 in a first embodiment according to the previous art.

Here below, the terms upstream and downstream are defined relative to the direction of gas flow through the turbomachine 1.

The turbomachine 1 includes an upstream turbine and a downstream turbine 3. For example, the upstream turbine 2 is a high-pressure turbine and the downstream turbine 3 is a low-pressure turbine or a free turbine. Each turbine 2, 3 has a rotor with blades 4. Turbomachine 1 also has a radially inner shaft 5, extending along the axis A of turbomachine 1.

Turbomachine 1 further comprises an annular channel 6 intended to form a flow path for the gas flow between two turbine stages 2, 3 of turbomachine 1, said channel 6 being delimited by a radially inner annular wall 7 and a radially outer annular wall 8.

A radially outer support 9 connects the outer annular wall and a turbine housing 10. The outer support 9 has a soft or elastically deformable zone 11 which allows radial and/or axial movement of the outer annular wall 8 relative to the housing 10.

A radially inner support 12 extends radially inward from the radially inner wall 7. The radially inner part 13 of the inner support 11 surrounds two bearings 14 mounted around shaft 5. The inner support 12 has a soft or elastically deformable zone 15 which allows radial and/or axial movement of the inner annular wall 7 relative to the bearings 14 and shaft 5.

The assembly formed by the annular channel 6 and the internal and external supports 9, 12 is made in one piece, for example by casting.

During operation, the inner and outer annular walls 7, 8 of the annular channel 6 are subject to high temperatures, while the inner support 12 and outer support 9 may be subject to lower temperatures. The temperature difference is particularly significant during the so-called transition phase, when the turbomachine starts up. This temperature difference generates differential expansions between different parts of the same assembly. The flexible zones 11, 15 of the supports 9, 12 make it possible to compensate for such differential expansions by allowing radial and/or axial displacement of the inner and outer annular walls 7, 8 of the annular channel 6 in relation to the other parts of the assembly.

However, too much flexibility given to the supports 9, 12 would penalize the guiding of shaft 5 through the bearings 14. Indeed, the supports 9, 12 have a so-called structural function since their function is to radially support shaft 5, i.e. to link it to the housing 10, and to avoid radial deflection of shaft 5, especially under load.

Therefore, a compromise has to be found between the aspects of flexibility to allow differential expansions and rigidity to achieve the supporting function of the shaft 5. In addition, the mechanical and thermal stresses applied to the various parts are significant and penalize the service life of the assembly.

In order to be able to meet the specifications, the assembly is made of, for example, Inconel 738 nickel-based alloy, as such material is expensive and cannot be repaired by weld build-up.

A second known embodiment of the prior art is shown in FIG. 2. In this embodiment, the assembly comprises an annular channel 6 intended to form a flow path for a gas stream between the two turbine stages 2, 3 of the turbomachine 1, said channel 6 being delimited by a radially inner annular wall 7 and a radially outer annular wall 8, said walls 7, 8 being connected by radially extending hollow arms 16.

The assembly further comprises a support 17, separate from the annular channel 6, and comprising a radially outer annular portion 9, located radially outside the outer annular wall 8 of the annular channel 6, and a radially inner annular portion 12, located radially inside the inner annular wall 7 of the annular channel 6, the outer 9 and inner 12 portions of the support 17 being connected by radially extending connecting portions 18, each connecting portion 18 passing through a hollow arm 16 of the annular channel 6.

In this way, it is possible to make the support 17 and the annular channel 6 in two different materials, making it easier to choose the material that meets the thermal and mechanical requirements of each part.

Such a solution remains costly, however, as it requires the manufacture and assembly of several separate parts. Indeed, such a solution requires the sectorization of support 17, the interface and the sealing between the different sectors generating additional constraints.

SUMMARY OF THE INVENTION

The invention aims to remedy such drawback in a simple, reliable and inexpensive way.

To this end, the invention concerns an assembly for a turbomachine, comprising:

an annular channel intended to form a flow path for a gas stream between two turbine stages of the turbomachine, said channel being delimited by a radially inner annular wall and a radially outer annular wall, said walls being connected by radially extending hollow arms, a support having a radially outer annular portion, located radially outside the outer annular wall of the annular channel, and a radially inner annular portion, located radially inside the inner annular wall of the annular channel, the outer and inner portions of the support being connected by radially extending connecting portions, each connecting part passing through one of the hollow arms of the annular channel, characterised in that at least one of the connecting parts of the support and the corresponding hollow arm are connected to each other by at least one connecting partition, said connecting partition comprising a breakable part capable of breaking when the mechanical stresses in said connecting partition are greater than a predetermined value.

The assembly can thus be made in one piece, for example by additive manufacturing or by casting, which reduces manufacturing costs. After breaking of the breakable part, the annular channel and the support form two separate parts, so as to avoid conduction or thermal bridges by contact between said parts.

The breakable part can be dimensioned to break when the shear stresses in the connecting partition at the breakable part are greater than 200 MPa.

The above mentioned stress value is, for example, the value when the connecting wall is at a temperature between 500 and 900° C., but this value may change with temperature.

The assembly is made in one piece from a nickel-based alloy, e.g. a C263 type alloy.

Preferably, the alloy used can be refilled by welding. This is particularly the case for a C263 type alloy.

The breakable part can be formed by a thinned area of the connecting partition.

The breakable part may have material removal, such as holes or localized depressed areas.

At least one of the connecting parts of the support may have an internal conduit for the supply of a lubricating fluid from an area located radially outside the annular channel to an area located inside the annular channel.

The radially inner part of the support may be designed to support at least one bearing. The conduit can thus allow the lubrication of said bearing.

The lubricating fluid is for example grease or oil.

The radially inner part and/or the radially outer part of the support may comprise at least one flexible zone allowing radial deformation of said radially inner or outer part.

The radially inner and/or radially outer part of the support may have a radially fixed peripheral part, connected to each connecting part by the corresponding flexible zone.

The flexible zone can be formed by elastically deformable tabs or pins.

Said tabs or pins may be oriented obliquely, i.e. may form a non-zero angle with the axial direction and with the radial direction. The angle with the axial direction is for example between 30 and 60°, preferably around 45°.

The invention relates to a turbomachine, such as for example a turbojet or turboprop, comprising an upstream turbine, for example a high-pressure turbine, and a downstream turbine, for example a low-pressure turbine or a free turbine, said turbines each comprising a rotor, the turbomachine comprising a radially inner shaft, characterised in that it comprises an assembly of the above mentioned type, the annular channel forming a gas flow path between the upstream turbine and the downstream turbine, the radially inner part of the support supporting at least one bearing serving to guide the shaft, the radially outer part of the support being fixed to a fixed part of the turbomachine, for example a turbine casing.

The invention also relates to a method for assembling and operating a turbomachine of the above mentioned type, characterised in that it includes the following steps:

mounting the annular channel and the support in the turbomachine, performing a first start-up of the turbomachine so as to create a temperature differential between the arms of the annular channel, on the one hand, and the connecting parts of the support, on the other hand, and to generate a break in the breakable part of the connecting partition due to the stresses generated in said breakable part.

The temperature differential allowing a break in the breakable zone is, for example, between 200 and 500° C.

Alternatively, the breakable part can be broken cold, i.e. without heating up a part of the assembly, before the annular channel and support are mounted in the turbomachine.

According to another embodiment, the breakable part can be broken cold, i.e. without heating up a part of the assembly, after the annular channel and support are mounted in the turbomachine.

For this purpose, a stress may be generated mechanically at the level of the connecting partition, for example by an operator, in particular by applying a shock or sufficient force to the connecting partition.

The invention will be better understood and other details, characteristics and advantages of the invention will appear when reading the following description, which is given as a non-limiting example, with reference to the attached drawings.

DETAILED DESCRIPTION

Figure 1:
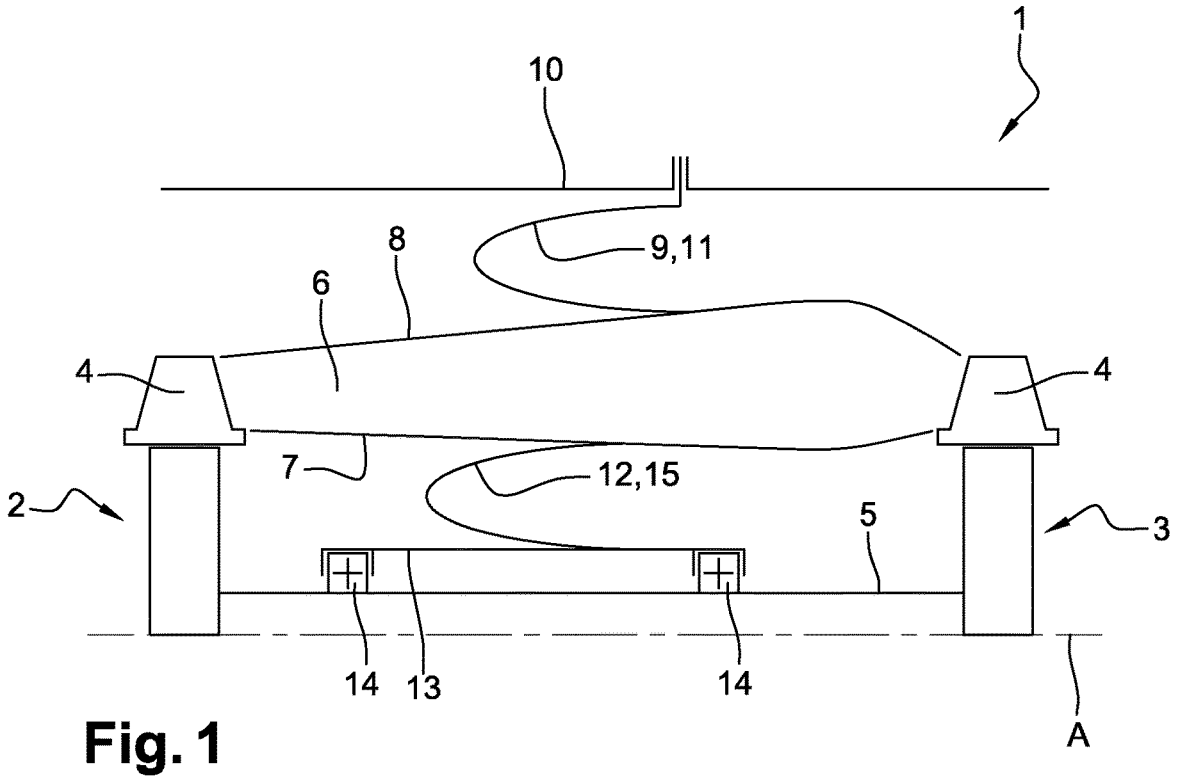
FIG. 1 is a schematic half-view in axial section of a portion of a turbine of a turbomachine according to a first embodiment of the prior art.
Figure 2:
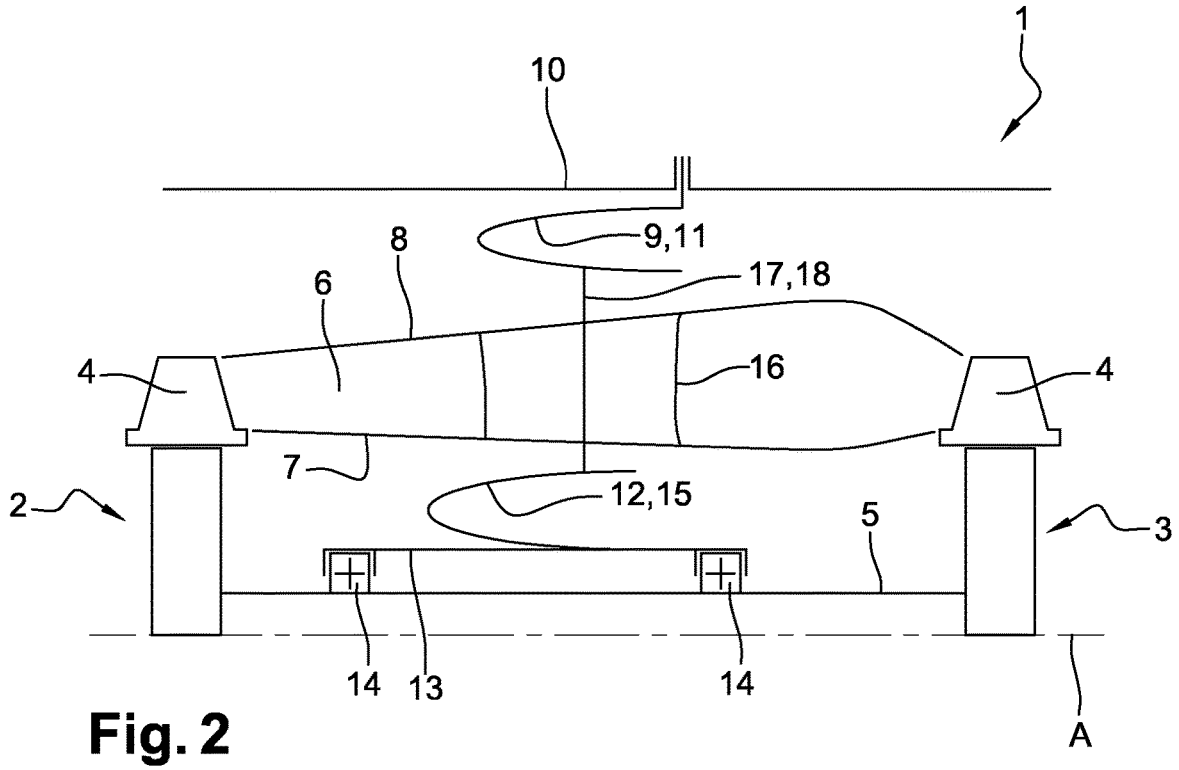
FIG. 2 is a view corresponding to FIG. 1, illustrating a second embodiment of the prior art.
Figure 3:
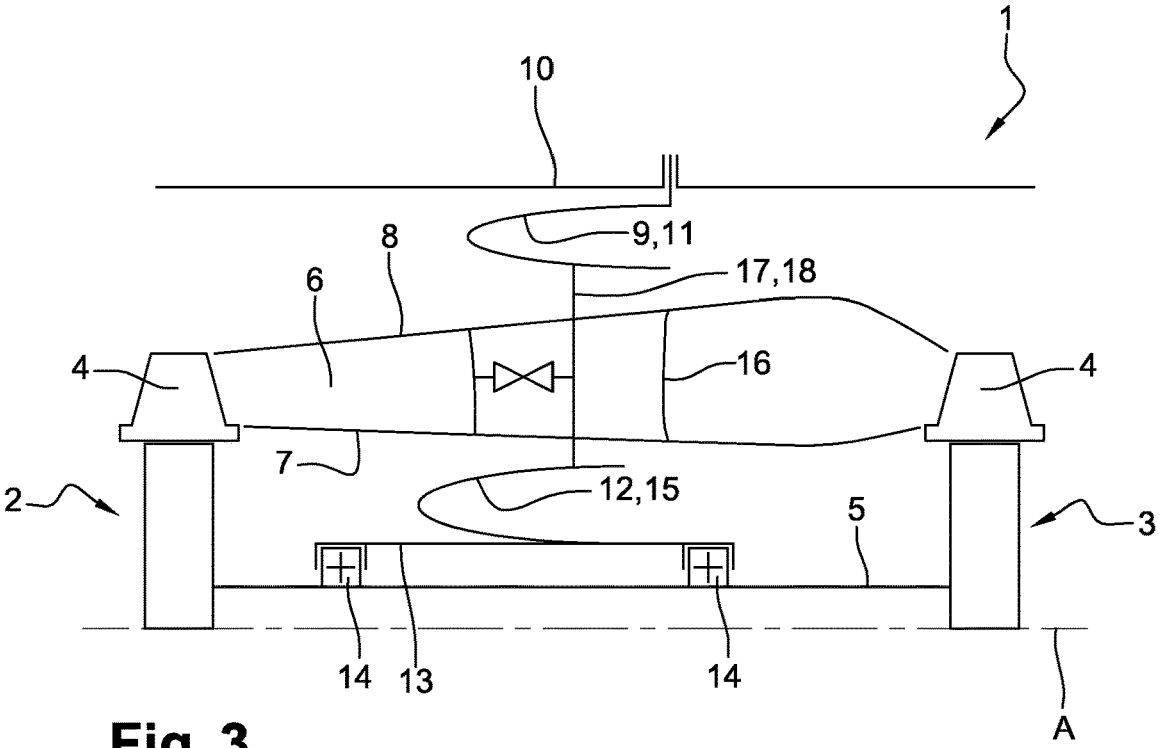
FIG. 3 is a view corresponding to FIG. 1 illustrating an embodiment of the invention.

FIG. 3 shows a portion of a turbomachine 1 according to an embodiment of the invention. The turbomachine includes an upstream turbine 2 and a downstream turbine 3. For example, the upstream turbine 2 is a high-pressure turbine and the downstream turbine 3 is a low-pressure turbine or a free turbine. Each turbine 2, 3 has a rotor with blades 4. Turbomachine 1 also has a radially inner shaft 5, extending along the axis A of turbomachine.

Turbomachine 1 also includes an assembly comprising an annular channel 6 intended to form a flow path for a gas stream between the two turbine stages 2, 3 of the turbomachine 1, said channel 6 being delimited by a radially inner annular wall 7 and a radially outer annular wall 8, said walls 7, 8 being connected by radially extending hollow arms 16.

Figure 4:
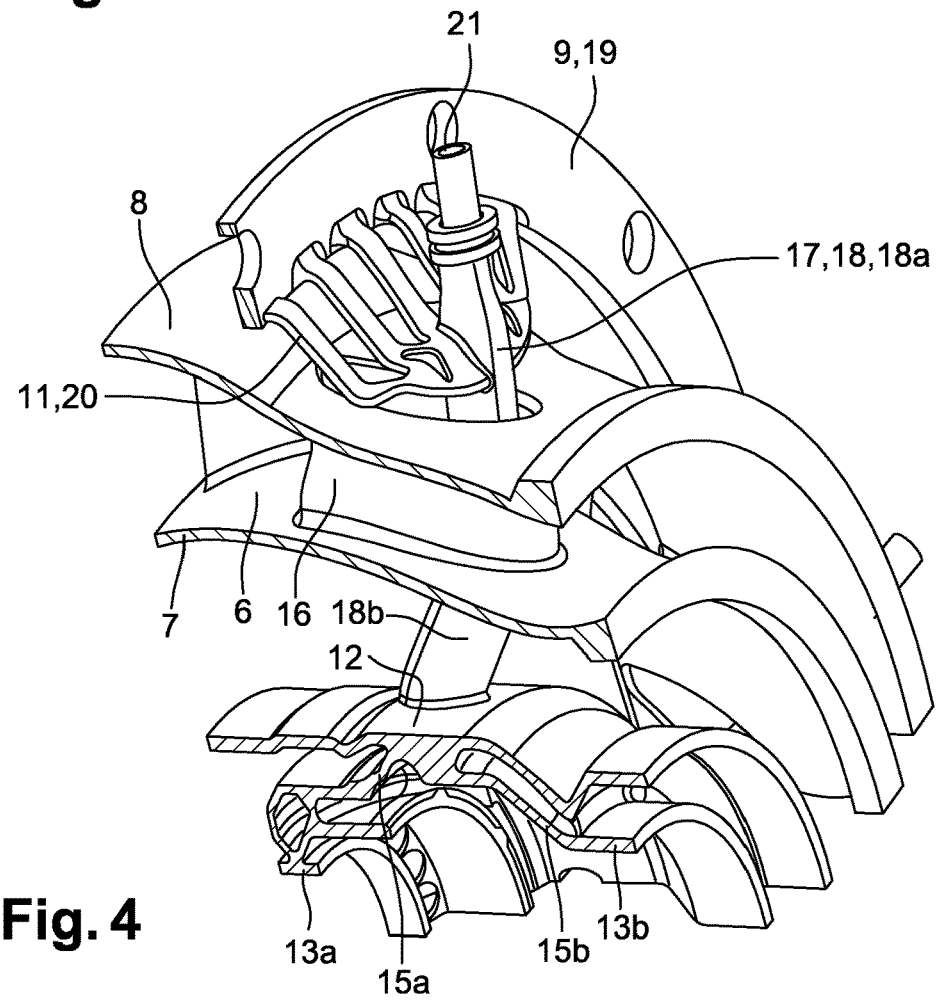
FIG. 4 is a perspective and axial section view of a portion of an assembly according to the invention.

The assembly, also visible in FIG. 4, further comprises a support 17 having a radially outer annular portion 9, located radially outside the outer annular wall 8 of the annular channel 6, and a radially inner annular portion 12, located radially inside the inner annular wall 7 of the annular channel 6, the outer 9 and inner 12 portions of the support 17 being connected by radially extending connecting portions 18, each connecting portion 18 passing through a hollow arm 16 of the annular channel 6. The hollow arms 16 and connecting parts 18 are evenly distributed around the circumference.

The radially inner part 12 and the radially outer part 9 of the support 17 each comprise a flexible zone 11, 15 allowing radial deformation of said radially inner or outer part 12, 9.

The radially inner part 12 has a radially outer, radially extending annular flange 19 which is fixed to the housing 10 by means of e.g. screws or rivets. Said flange 19 is connected to each connecting part 18 by the corresponding flexible zone 11. This flexible zone 11 can be formed by elastically deformable tabs or pins 20.

Said tabs or pins 20 may be oriented obliquely, i.e. may form a non-zero angle with the axial direction and with the radial direction. The angle with the axial direction is for example between 30 and 60°, preferably around 45°.

In addition, the radially inner part 12 of support 17 has axially extending annular parts 13*a*, 13*b*, each intended to surround one of the bearings 14. Each annular part 13*a*, 13*b* is connected to the connecting parts 18 by flexible zones 15*a*, 15*b* oblique or frustoconical. Each oblique or frustoconical flexible zone 15*a*, 15*b* forms a non-zero angle with the axial and radial directions.

At least one of the connecting parts 18 of the support 17 has an internal conduit 21 for the supply of a lubricating fluid from an area located radially outside the annular channel 6 up to an area located at the level of the bearings 14. The lubricating fluid is for example grease or oil.

Each connecting part may have two straight parts 18*a*, 18*b* at an angle to each other. Of course, other embodiments are also possible.

Figure 5:
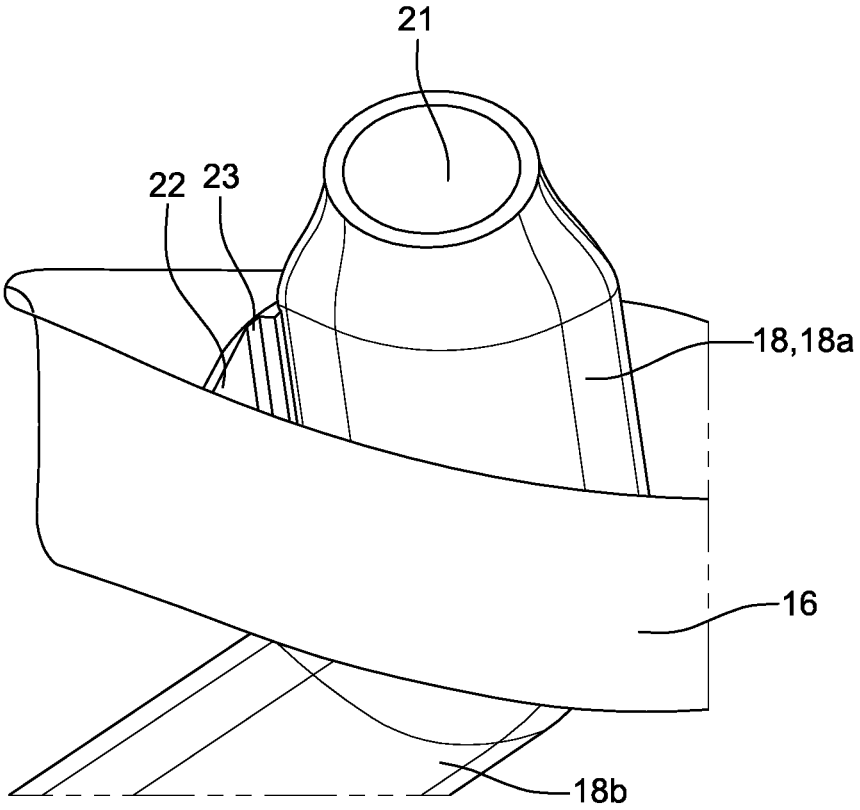
FIG. 5 is a perspective view of a portion of the assembly of FIG. 4, with some elements removed to improve the visibility of the represented elements.

As is best seen in FIG. 5, at least one of the connecting parts 18 and the corresponding hollow arm 16 are connected to each other by at least one connecting partition 22, said connecting partition 22 having a breakable part 23 capable of breaking when the mechanical stresses in said connecting partition 22 are greater than a predetermined value.

It should be noted that, except through the connecting partition 22, the connecting part 18 is not in contact with the surface of the connecting arm 16, so as to limit heat exchange.

The breakable part 23 can be dimensioned to break when the shear stresses in the connecting partition 22 at the level of the breakable part 23, are greater than 200 MPa. This value can change with temperature and can for example be set at a temperature between 500° C. and 900° C.

The assembly formed by channel 6 and support 17 can thus be made in one piece, for example by additive manufacturing or by casting, which reduces manufacturing costs. After breaking of the breakable part 23, the annular channel 6 and the support 17 form two separate parts, so as to avoid conduction or thermal bridges by contact between said parts 6, 17.

The assembly is made in one piece from a nickel-based alloy, e.g. a C263 type alloy.

Figure 6:
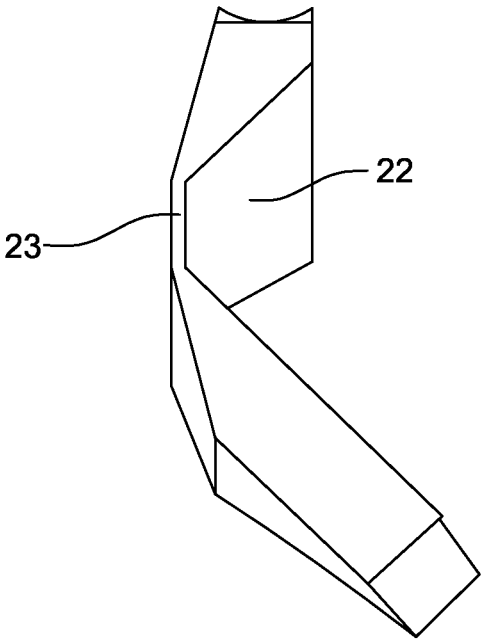
FIG. 6 is a perspective view of a part of said connecting partition.

As can be better seen in FIG. 6, the breakable portion 23 of connecting partition 22 is formed by a thinned area of connecting partition 22.

The breakable part 23 may have material removal, such as holes or localized depressed areas.

According to a first embodiment, the assembly is mounted in a single piece or in a single block in the turbomachine 1, then, during the first start-up of the turbomachine 1, a temperature differential is created between the arms 16 of the annular channel 6, on the one hand, and the connecting parts 18 of the support 17, on the other hand, which has the effect of breaking the breakable part 23 of the connecting partition 22 because of the stresses generated in said breakable part 23.

The temperature differential allowing a break in the breakable zone is, for example, between 200 and 500° C.

Alternatively, the breakable part 23 can be broken cold, i.e. without heating up a part of the assembly, before the annular channel 6 and support 17 are mounted in the turbomachine 1.

According to another embodiment, the breakable part 23 can be broken cold, i.e. without heating up a part of the assembly, after the annular channel 6 and support 17 are mounted in one piece in the turbomachine 1.

For this purpose, a stress may be generated mechanically at the level of the connecting partition 22, for example by an operator, in particular by applying a shock or sufficient force to the connecting partition 22.

The invention claimed is:

1. An assembly for a turbomachine, comprising:

an annular channel intended to form a flow path for a gas stream between two turbine stages of the turbomachine, said channel being delimited by a radially inner annular wall and a radially outer annular wall, said walls being connected by radially extending hollow arms, and a support having a radially outer annular portion, located radially outside the outer annular wall of the annular channel, and a radially inner annular portion, located radially inside the inner annular wall of the annular channel, the outer and inner portions of the support being connected by radially extending connecting portions, each connecting portion passing through a hollow arm of the annular channel, wherein at least one of the connecting parts of the support and the corresponding hollow arm are connected to each other by at least one connecting partition, said connecting partition having a breakable part capable of breaking when the mechanical stresses in said connecting partition are greater than a predetermined value.

2. The assembly according to claim 1, wherein the breakable portion is dimensioned to break when the shear stresses in the connecting partition at the breakable portion are greater than 200 MPa.

3. The assembly according to claim 1, wherein the assembly is made in one piece from a nickel-based alloy.

4. The assembly according to claim 1, wherein the breakable portion is formed by at least one thinned part of the connecting partition.

5. The assembly according to claim 1, wherein the breakable part comprises material removals.

6. The assembly according to claim 1, wherein at least one of the connecting parts of the support may have an internal conduit for the supply of a lubricating fluid from an area located radially outside the annular channel up to an area located inside the annular channel.

7. The assembly according to claim 1, wherein the radially inner part and/or the radially outer part of the support comprise at least one flexible zone allowing radial deformation of said radially inner or outer part.

8. The assembly according to claim 7, wherein the radially inner part and/or the radially outer part of the support has a radially fixed peripheral part, connected to each connecting part by the corresponding flexible zone.

9. A turbomachine comprising an upstream turbine and a downstream turbine, said turbines each comprising a rotor, the turbomachine comprising a radially inner shaft, wherein the turbomachine comprises an assembly according to claim 1, the annular channel forming a gas flow path between the upstream turbine and the downstream turbine, the radially inner part of the support supporting at least one bearing serving to guide the shaft, the radially outer part of the support being fixed to a fixed part of the turbomachine.

10. A method of assembling and operating the turbomachine according to claim 9, the method comprising:

mounting the annular channel and the support in the turbomachine; and performing a first start-up of the turbomachine to create a temperature differential between the arms of the annular channel, on the one hand, and the connecting parts of the support, on the other hand, and to generate a break in the breakable part of the connecting partition due to the stresses generated in said breakable part.

11. The turbomachine of claim 9, wherein the turbomachine is one of a turbojet or turboprop.

12. The turbomachine of claim 9, wherein the upstream turbine is a high-pressure turbine.

13. The turbomachine of claim 9, wherein the downstream turbine is a low-pressure turbine or a free turbine.

14. The assembly according to claim 3, wherein a nickel-based alloy comprises an alloy of type C263.

15. The assembly according to claim 5, wherein the material removals comprise at least one of holes and localized depressed areas.

16. The turbomachine according to claim 9, wherein the fixed part of the turbomachine is a turbine casing.

* * * * *